United States Patent [19]

Hartwell

[11] 4,244,065

[45] Jan. 13, 1981

[54] WATER BED CONSTRUCTION

[76] Inventor: David Hartwell, 3830 Blaisdell Ave., Minneapolis, Minn. 55409

[21] Appl. No.: 40,674

[22] Filed: May 21, 1979

[51] Int. Cl.[3] ..... A47B 27/08

[52] U.S. Cl. ..... 5/400; 5/451; 5/401; 5/481

[58] Field of Search ..... 5/400, 401, 450, 451, 5/473, 481

[56] References Cited

U.S. PATENT DOCUMENTS

| | | | |
|---|---|---|---|
| 3,308,491 | 3/1967 | Spence | 5/450 |
| 3,600,727 | 8/1971 | Williams | 5/450 |
| 3,702,484 | 11/1972 | Tobinick et al. | 5/451 |
| 3,742,531 | 7/1973 | Alsbury et al. | 5/400 |

*Primary Examiner*—Casmir A. Nunberg

[57] ABSTRACT

Construction for a water bed including a bladder filled with water or other fluid, a foam rubber framing element which is provided with a bladder receiving recess which provides a peripheral frame for the bladder and an upper surface within the frame upon which the bladder will rest. The foam rubber framing unit and the water bladder is supported and carried by a mattress and box spring of normal construction or may be supported and carried by the box spring singularly.

2 Claims, 2 Drawing Figures

WATER BED CONSTRUCTION

FIELD OF THE INVENTION

This invention relates generally to bedding and bed constructions and more particularly to the construction of a water bed and including the use thereof in conjunction with a mattress and box spring.

BACKGROUND AND OBJECTS OF THE INVENTION

The interest in and the use of water beds has increased greatly in the last several years. This interest has resulted in many modifications and changes in the structure of such beds. The water bed structure as disclosed herein encompasses modifications from the normally constructed bed and although the inventors or the bed as described herein are knowledgeable in the art and are acquainted with the structures of such beds as are currently being produced, they have been unable to find a unit which embodies either the structure or the concepts as disclosed herein.

The normally provided water bed provides a fluid retaining bladder surrounded by a retaining frame with a continuous, solid support which provides the surface upon which the bladder rests. The bladder normally provides sufficient support for a person reclining thereon but should a person sit thereupon, the concentration of weight will often displace enough water to cause the person to sit upon the solid support. The amount of water and the size of the bladder, though comfortable to some persons, due to the undulations and water movement is disconcerting to other persons. One of the primary objects of this invention is to provide a water bed structure that will provide total body support to the person reclining thereon and will include a cushioning support upon which the bladder rests. The water bed structure as shown herein provides a bladder and a cushioning supporting structure to overcome the disadvantages of a normal water bed.

It is a further object of this invention to provide a water bed construction which incorporates a fluid holding and retaining bladder of a sufficient thickness to provide total support for the body of a person reclining thereon while eliminating the fluid undulations associated with a fluid bladder of greater liquid capacity.

It is still a further object of this invention to provide a water bed construction which includes a resilient frame therearound to retain the normal rectangular configuration of the bladder and providing a cushion therearound for the person using the same.

It is still a further object of this invention to provide a water bed construction which includes a fluid retaining bladder and a resilient bladder receiving framework to provide support around the sides of the bladder and to support the flat underside thereof.

Figure 1:
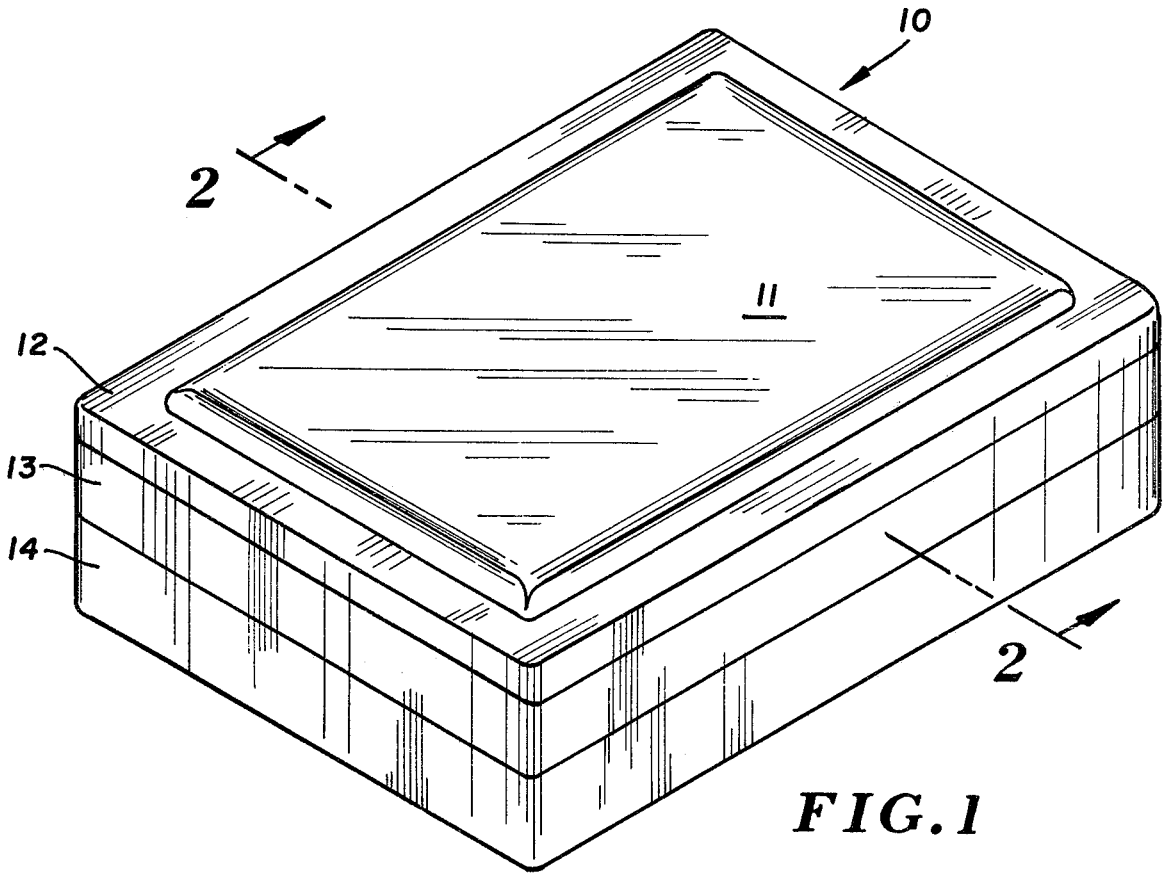
Figure 2:
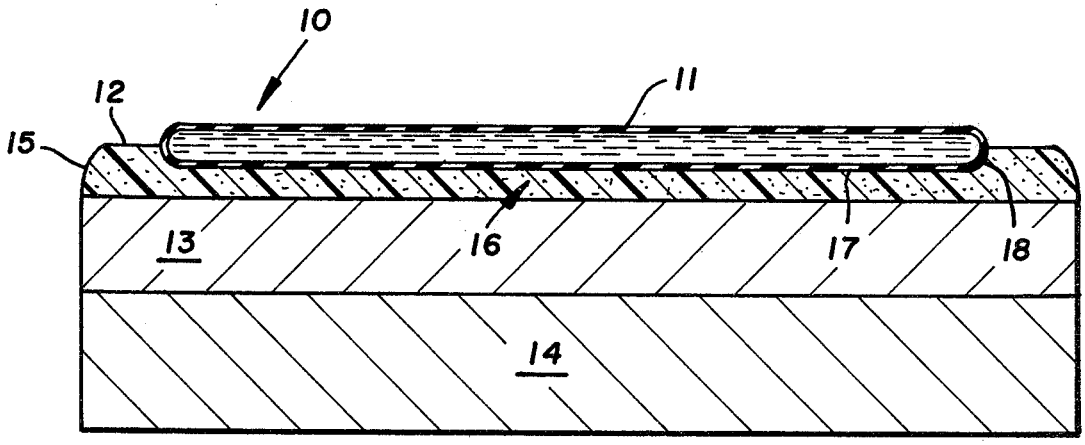

These and other objects and advantages of this invenion will more fully appear from the following disclosure made in conjunction with the accompanying drawings in which the same numeral or indicia is utilized to indicate the same or similar parts throughout the several views, and in which:

FIG. 1 is a perspective view of a water bed embodying the concepts of this invention and illustrating same in its most complete form; and, FIG. 2 is a vertical section taken subtantially along Line 2—2 of FIG. 1.

In accordance with the accompanying drawings, the water bed construction of the invenion is designated, in its entirety, 10 and includes a water or fluid holding bladder 11, a resilent bladder retaining frame 12, a mattress 13 and a box spring unit 14. As stated, a primary consideration of the invention is to provide a unit which will achieve the benefits and comforts of a water bed without the possible disconcerting aspects thereof and therefore, the unit is illustrated in its most complete form as including a mattress and a box spring. Variations of this complete form, while still retaining the objects of the invention, are available without departing from the scope of the invention.

As a first consideration, the mattress 13 and the box spring 14 may be provided from any of the standard constructions and for this reason it is not thought to be necessary to enter into a description of the construction of the structure thereof.

It has also been found that it is not necessary to include both of these elements into the invention to obtain all the benefits thereof but, preferrably, if it is desired to eliminate either of these elements, it is possible to eliminate the mattress without eliminating any great degree of comfort to the user.

The fluid bladder 11 provides a generally rectangular member formed from a proper fluid holding material with dimensions which are selected in accordance with the type and size of bed upon which the same is to be used. It is well known in the art that beds are of various sizes and include single, double, queen and king size beds. The bladder 11 will have a width and a length wlightly less than the corresponding width and length for the type of bed to which it is designed.

Obviously means, not shown, for filling the bladder 11 must be provided.

A particular consideration of the thickness of the bladder is to provide a bladder which will properly support a body without undue undulations of fluid. This thickness will be coordinated to the thickness of the resilient retaining frame 12 and the bed upon which it is to be used.

The retaining frame 12, in the form shown, includes a generally rectangular member having the upper peripheral edges 15 downwardly curved and providing a bladder receiving recess 16 formed therein. The recess 16 provides a generally flat bottom 17 with upstanding peripheral edges 18. The bottom 17 of the recess 16 obviously supports the entire bottom of the bladder 11 while the upstanding peripheral edges of this recess provide a framing element for the sides of the bladder 11 received therein.

As stated, the thickness of the filled bladder bears a correlation to the thickness of the frame 12 and it has been found that approximately one-half to two-thirds of the bladder should be received into the recess 16 therefore leaving one-third to one-half of the bladder exposed. As an example, when using a resilient frame formed from or including the dimensions of standardly provided mattresses of foam rubber for the retaining frame 12, the thickness of the frame 12 is approximately four inches and therefore, if the recess formed therein is of a one inch depth, it may be calculated that thickness of the bladder would be one and one-half inches to two inches, thereby leaving one-half to one inch of the bladder above the height of the retaining frame surrounding the same.

As described above, applicant has provided a dimensional analysis for one form of the invention. In certain jurisdictions, the laws are formulated to provide that the supporting frame and a liner must be provided to capture the entire contents of the bladder. In order to comply with such regulations, it should be obvious that the depth of the recess 16 may be provided without departing from the scope of the invention.

This sizing and thickness variation may vary, but it sould be obvious, that with the added cushioning of the resilient frame underlying the bladder, it is not necessary to provide a bladder of a great dimension in order to obtain the desired comfort.

With the water bed construction as disclosed herein, including the bladder and the cushioning retaining frame and including either the mattress and box spring unit or simply including the box spring unit, it should be obvious that a unique modification for water bed construction has been provided. One important advantage with the concept included herein is the lower weight of the entire structure. With the water beds that may be considered as standard, the bladder is filled with a large quantity of water and as a result, additional problems are present. A major problem is the weight of the structure due to the large amount of water and the other is the possibility of water damage due to leakage. The device and structure as disclosed herein eliminates or at least substantially reduces these problems.

What is claimed is:

1. A water bed structure including:

a. a fluid retaining bladder of a generally rectangular shape and of a first predetermined thickness;

b. a retaining frame formed of a resilient material and being of a generally rectangular shape and of a second predetermined thickness and providing an upper and a lower surface;

c. a recess formed in said retaining frame in said upper surface thereof; and, d. said bladder receiving recess being of a depth less than said first predetermined thickness of said bladder.

2. The structure set forth in claim 1 the depth of said recess in said retaining frame being from one-half to two-thirds of the thickness of said bladder.

* * * * *